United States Patent [19]

Storton

[11] Patent Number: 4,832,222

[45] Date of Patent: May 23, 1989

[54] PORTABLE FOLDING TRASH BIN

[76] Inventor: John E. Storton, 2133 Grace, Ft. Worth, Tex. 76111

[21] Appl. No.: 128,623

[22] Filed: Dec. 4, 1987

[51] Int. Cl.[4] ..... B65D 6/16

[52] U.S. Cl. ..... 220/6; 220/1 T; 211/71; 248/DIG. 7

[58] Field of Search ..... 220/1 T, 6, 401; 211/71, 84, 126, 133, 180, 181; 248/DIG. 7

[56] References Cited

U.S. PATENT DOCUMENTS

| | | | |
|---|---|---|---|
| 1,162,575 | 11/1915 | Craig | 248/DIG. 7 |
| 1,477,624 | 12/1923 | Bates | 220/6 |
| 2,738,940 | 3/1956 | Coit | 220/6 |
| 2,806,623 | 9/1957 | Beckner | 220/6 |
| 2,821,047 | 1/1958 | Ruiz | 220/6 |
| 3,510,055 | 5/1970 | Safford | 211/71 |
| 3,547,273 | 12/1970 | Bompart | 211/84 |
| 4,174,046 | 11/1979 | Atkins | 220/6 |
| 4,339,048 | 7/1982 | McMillen et al. | 211/71 |

*Primary Examiner*—David T. Fidei

*Attorney, Agent, or Firm*—Henderson & Sturm

[57] ABSTRACT

A portable folding trash bin of a type which has two rigid rectangular side frames which are covered with wire mesh attached hingedly to rigid end frames which are also covered with wire mesh. A pair of lids are pivotally attached to the top of the end frames to completely enclose plastic bags or garbage cans disposed within the portable folding trash bin. A unique anchoring system is provided which permits four tubular members to be permanently installed in the ground and four anchor rods having hooks on the top thereof are adapted to be selectively received into such tubular rods or selectively moved therefrom as desired.

4 Claims, 2 Drawing Sheets

PORTABLE FOLDING TRASH BIN

TECHNICAL FIELD

The present invention relates generally to a trash bin and more particularly to a foldable portable trash bin for preventing animals from getting into trash which has been collected in plastic bags or trash cans prior to the time that they are picked up by trash collection services.

BACKGROUND ART

It is a well known problem that garbage cans or trash bags filled with refuse or the like are placed out for pick up by garbage pickup services or the like that animals, such as dogs and cats, often rip open the plastic bags or tip over the garbage cans. Various devices such as U.S. Pat. Nos. 3,065,858 to Furr, 3,407,941 to Schmidt or 3,924,913 to Cooper have been devised to solve this problem. A problem with the first two aforementioned patents is that the structures disclosed therein are not as simple and as portable as is desired and the latter patent mentioned above is not entirely satisfactory either because animals can reach over the top of the enclosure. Consequently, there remains a need for a folding portable trash bin which overcomes the aforementioned problems.

DISCLOSURE OF THE INVENTION

The present invention relates generally to a portable folding trash bin of a type which has two rigid rectangular side frames which are covered with wire mesh attached hingedly to rigid end frames which are also covered with wire mesh. A pair of lids are pivotally attached to the top of the end frames to completely enclose plastic bags or garbage cans disposed within the portable folding trash bin. A unique anchoring system is provided which permits four tubular members to be permanently installed in the ground and four anchor rods, having hooks on the top thereof, are adapted to be selectively received into such tubular rods or selectively moved therefrom as desired.

An object of the present invention is to provide an improved trash bin for holding plastic bags or garbage cans full of trash.

Another object of the present invention is to provide a trash bin which is portable so that it can be easily anchored along a front curb where trash is normally picked up and yet which can easily be removed and stored.

A further object of the present invention is to provide a portable trash bin which can easily be folded up and stored in a very small space.

Other objects, advantages, and novel features of the present invention will become apparent from the following detailed description of the invention when considered in conjunction with the accompanying drawings.

BEST MODE FOR CARRYING OUT THE INVENTION

Figure 1:
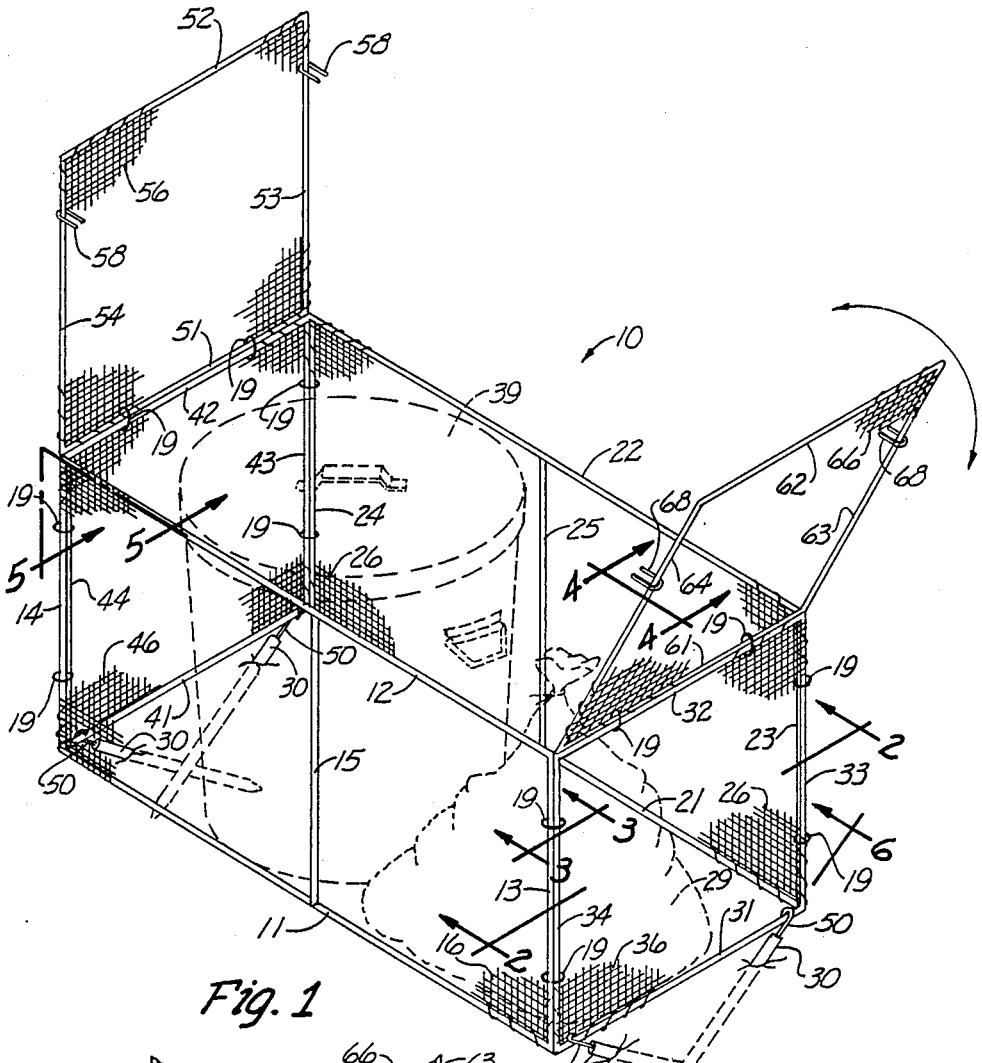
FIG. 1 is a perspective view of a portable trash bin constructed in accordance with the present invention and having wire mesh attached to all the panels thereof, FIG. 1 also showing in dashed lines a plastic bag and a garbage can full of trash which could be stored therein.
Figure 5:
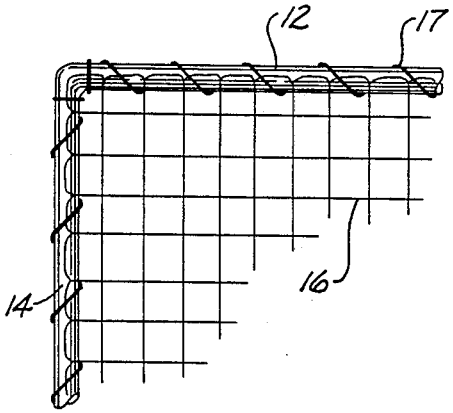
FIG. 5 is an enlarged partial view taken along line 5—5 of FIG. 1.
Figure 6:
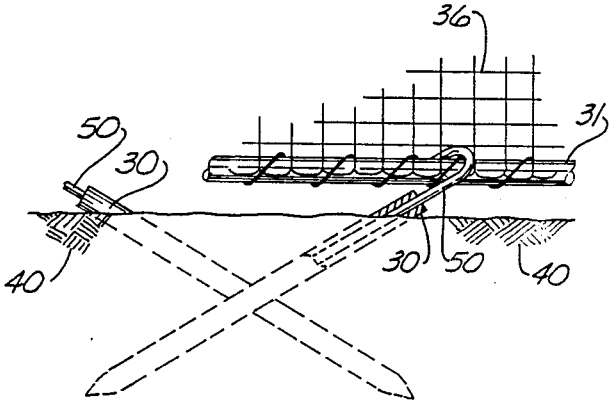
FIG. 6 is an enlarged cross sectional view taken along line 6—6 of FIG. 1.

Referring now to the drawings wherein like reference numerals designate identical or corresponding parts throughout the several views, FIG. 1 shows a portable folding trash bin (10) constructed in accordance with the present invention. A first rectangular side frame has a lower rigs metal rod (11), an upper horizontal rigid rod (12), a first vertical rigid rod (13) and a second horizontal rigid rod (14) all welded together. Alternatively, such first frame can be bent into a U-shape and then, for example, the rod (14) could be welded to one end of the U and a brace member (15) welded in the center thereof to the lower rigid rod (11) and the upper rigid rod (12). A first wire mesh (16) on the first rigid rod member is wrapped thereon with wire (17) as is shown in FIG. 5.

A second rigid rectangular side frame is essentially identical to the first rigid rectangular side frame and has a second lower horizontal rigid rod (21), a second upper horizontal rigid rod (22), a third vertical rigid rod (23), a fourth vertical rigid rod (24), a rigid brace member (25) and a second wire mesh (26).

A first rigid end frame is shown on the right side of the structure of FIG. 1 and includes a third lower horizontal rigid rod (31), a third upper horizontal rigid rod (32), a fifth vertical rigid rod (34) and a sixth vertical rigid rod (33). A third wire mesh (36) is attached to the frame members just like as shown in FIG. 5.

A second end frame is identical to the first end frame and includes a fourth lower horizontal rigid rod (41), a fourth upper horizontal rigid rod (42), a seventh vertical rigid rod (44) and an eighth horizontal rigid rod (43) all welded together to form a rigid frame and having a wire mesh (46) which covers the entire end. It is important to note that in FIGS. 1 and 2 the wire mesh is shown only partially but is to be understood that it would cover the entire first and second side frames, and the first and second end frames as well as covering the lids, which will be discussed below.

The lids, which are shown open in FIGS. 1, are essentially identical to the first and second rigid end frames. The lid on the left includes rigid rod members (51), (52), (53) and (54) rigidly attached together and having wire mesh (56) attached thereto. U-shaped members (58) are provided for preventing the lids from falling into the bin and also for preventing the top rods (12) and (22) of the sides from being easily bent by animals. The other lid includes rigid rods (61), (62), (63) and (64) all welded together in a rigid fashion and being covered by wire mesh (66) and having U-shaped members (68) rigidly attached thereto for the same reason as the U-shaped member (58) on the other lid.

Hinge loops (19) on each side of washers (20) are used to attach the side frames to the end frames and the lids to the end frames so that the entire portable folding trash bin (10) can be folded up for storage when not in use and also for permitting the lids to pivot from the position shown in FIG. 1 to a closed position wherein they would be horizontal and over the trash bag (29) and the trash can (39) as shown in dashed lines in FIG. 1.

Figure 2:
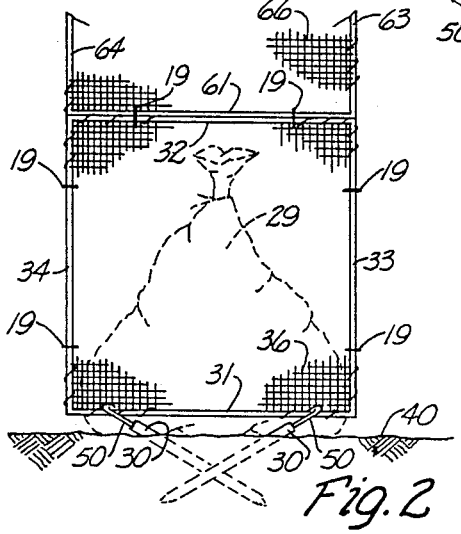
FIG. 2 is a view along line 2—2 of FIG. 1.
Figure 3:
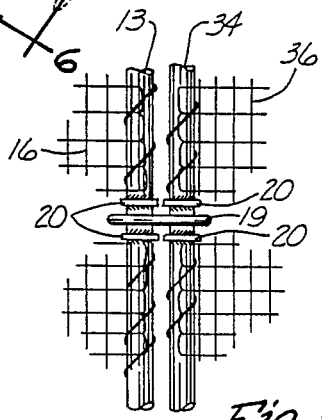
FIG. 3 is an enlarged partial cross sectional view taken along line 3—3 of FIG. 1.
Figure 4:
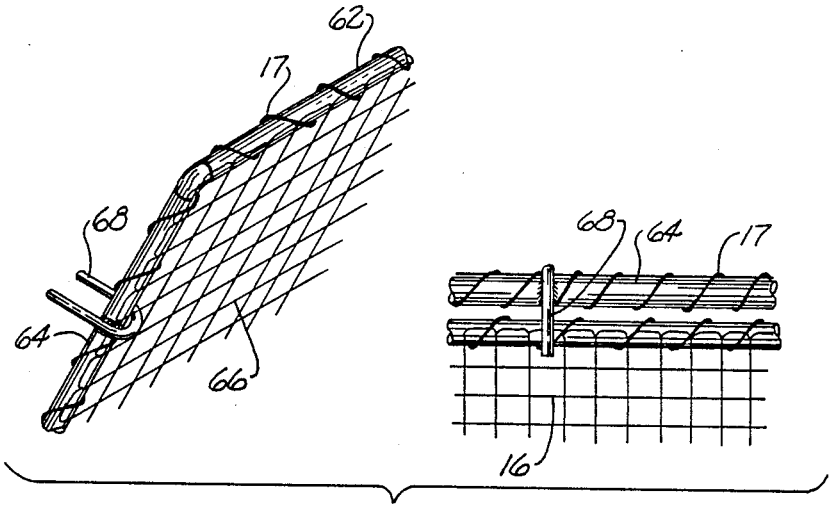
FIG. 4 is an enlarged partial cross sectional view taken along line 4—4 of FIG. 1.

The anchoring system of the present invention comprises a pair of pipes (30) on each end of the portable folding trash bin (10) which are driven into the ground (40) as can be seen in FIGS. 1 and 2. Rods. (50) have a loop on the top end thereof which extend over lower horizontal rods (31) and (41) so that when the rods (50) are placed into the tubular pipes (30), the trash bin is held down to prevent animals from pulling it up or tipping it over but allows a person to quickly and easily pull the rods out to disengage the portable folding trash bin (10) from the ground.

Accordingly, it will be appreciated that if the pipes (30) are driven into the ground in the place where the portable folding trash bin is to be deployed, then the trash bin (10) can quickly and easily be taken from a garage or basement on the day that trash is to be collected, and anchored with anchor rods (50) to secure trash bags (29) or trash cans (39). Then, at the end of the day after the trash has been removed from the bin (10), the achor rods (50) can be removed, the trash bin (10) can be easily and quickly folded and stored away until the time it is to be used again.

Obviously, many modifications and variations of the present invention are possible in light of the above teachings. It is therefore to be understood, that, within the scope of the appended claims, the invention may be practiced otherwise than as specifically described.

I claim:

1. A portable folding trash bin comprising:

a first rigid rectangular side frame, said first side frame including a first lower horizontal rigid rod, a first upper horizontal rigid rod, a first vertical rod rigidly attached at the top thereof to one end of said first upper rod and rigidly attached at the bottom thereof to one end of said first lower rod, a second vertical rigid rod rigidly attached at the top thereof to the other end of said first upper rod and at the bottom thereof to the other end of said first lower rod;

a first wire mesh attached to and suspended between the first upper and lower rods and attached to and suspended between the first and second vertical rods;

a second rigid rectangular side frame, said second side frame including a second lower horizontal rigid rod, a second upper horizontal rigid rod, a third vertical rigid rod rigidly attached at the top thereof to one end of said second upper rod and rigidly attached at the bottom thereof to one end of said second lower rod, a fourth vertical rigid rod rigidly attached at the top thereof to the other end of said second upper rod and at the bottom thereof to the other end of said second lower rod;

a second wire mesh attached to and suspended between the second upper and lower rods and attached to and suspended between the third and fourth vertical rods;

a first end frame, said first end frame including a third lower horizontal rigid rod, a third upper horizontal rigid rod, a fifth vertical rod rigidly attached at the top thereof to one end of said third upper rod and rigidly attached at the bottom thereof to one end of said third lower rod, a sixth vertical rigid rod rigidly attached at the top thereof to the other end of said third upper rod and at the bottom thereof to the other end of said third lower rod;

a third wire mesh attached to and suspended between the third upper and lower rods and attached to and suspended between the fifth and sixth vertical rods;

a second rigid end frame, said second end frame including a fourth lower horizontal rigid rod, a fourth upper horizontal rigid rod, a seventh vertical rod rigidly attached at the top thereof to one end of said fourth upper rod and rigidly attached at the bottom thereof to one end of said fourth lower rod, an eighth vertical rigid rod rigidly attached at the top thereof to the other end of said fourth upper rod and at the bottom thereof to the other end of said fourth lower rod;

a fourth wire mesh attached to and suspended between the fourth upper and lower rods and attached to and suspended between the seventh and eighth vertical rods;

first hinge means for pivotally attaching first vertical rod to said fifth vertical rod;

second hinge means for pivotally attaching said second vertical rod to said seventh vertical rod;

third hinge means for pivotally attaching said third vertical rod to said sixth vertical rod;

fourth hinge means for pivotally attaching said fourth vertical rod to said eighth vertical rod;

lid means pivotally attached to one of said upper rods; and means for anchoring said first and second end frames to the ground, said anchoring means comprising:

a first tubular member disposed in the ground at an angle of less than 45 degrees with respect to horizontal;

a second tubular member disposed in the ground at an angle of less than 45 degrees with respect to horizontal, said second tubular member being adjacent to and being transverse with respect to said first tubular member;

a third tubular member disposed in the ground at an angle of less than 45 degrees with respect to horizontal;

a fourth tubular member disposed in the ground at an angle of less than 45 degrees with respect to horizontal, said fourth tubular member being adjacent to and being transversely with respect to said third tubular member;

a first anchor rod having one end thereof slidably disposed in said first tubular member, the other end of said anchor rod having a hook thereon disposed over one portion of said third lower horizontal rigid rod;

a second anchor rod having one end thereof slidably disposed in said second tubular member, the other end of said anchor rod having a hook thereon disposed over another portion of said third lower horizontal rigid rod;

a third anchor rod having one end thereof slidably disposed in said third tubular member, the other end of said third anchor rod having a hook thereon disposed over a first portion of said fourth lower horizontal rigid rod; and a fourth anchor rod having one end thereof slidably disposed in said fourth tubular member, the other end of said fourth anchor rod having a hook thereon disposed over a second portion of said forth lower horizontal rigid rod whereby and first, second, third and fourth anchor rods can be selectively removed from said first, second, third and fourth tubular members to permit said portable folding trash bin to be detached from the ground and folded for storage.

2. A portable folding trash bin as defined in claim 1 wherein said lid means comprises:

a first wire mesh covered rigid parallelogram frame pivotally attached to said third upper horizontal rigid rod; and a second wire mesh covered rigid parallelogram frame pivotally attached to said fourth upper horizontal rigid rod.

3. A portable folding trash bin as defined in claim 2 wherein a first U-shaped member is rigidly attached to said first parallelogram frame and extends to each side of said first upper horizontal rod when said lid means is closed and a second U-shaped member is rigidly attached to said first parallelogram frame and extends to each side of said second upper horizontal rod when said lid means is closed.

4. A portable folding trash bin as defined in claim 3 wherein a third U-shaped member is rigidly attached to said second parallelogram frame and extends to each side of said first upper horizontal rod when said lid means is closed and a fourth U-shaped member is rigidly attached to said second parallelogram frame and extends to each side of said second upper horizontal rod when said lid means is closed.

* * * * *